US009899008B1

(12) United States Patent
Williams

(10) Patent No.: US 9,899,008 B1
(45) Date of Patent: Feb. 20, 2018

(54) BRIDGE AND BRIDGE ASSEMBLY FOR STRINGED INSTRUMENTS

(71) Applicant: John Dyer Williams, Clarksville, TN (US)

(72) Inventor: John Dyer Williams, Clarksville, TN (US)

( * ) Notice: Subject to any disclaimer, the term of this patent is extended or adjusted under 35 U.S.C. 154(b) by 0 days.

(21) Appl. No.: 15/407,840

(22) Filed: Jan. 17, 2017

(51) Int. Cl.
*G10D 3/14* (2006.01)
*G10D 3/04* (2006.01)
*G10D 3/12* (2006.01)

(52) U.S. Cl.
CPC ..... *G10D 3/04* (2013.01); *G10D 3/12* (2013.01); *G10D 3/14* (2013.01)

(58) Field of Classification Search
CPC ..... G10D 3/12; G10D 3/14; G10D 3/04
See application file for complete search history.

(56) References Cited

U.S. PATENT DOCUMENTS 282,147 A 7/1883 Anderberg
490,528 A 1/1893 Wooster
3,892,159 A 7/1975 Houtsma
4,464,970 A 8/1984 Mischakoff
4,724,737 A 2/1988 Fender
4,768,414 A 9/1988 Wheelwright
4,915,006 A * 4/1990 Steinberger ..... G10D 3/04 84/314 N
6,133,515 A 10/2000 Hoshino
7,855,330 B2 12/2010 Lyles et al.
8,076,559 B2 12/2011 Toone

* cited by examiner

*Primary Examiner* — Kimberly Lockett
(74) *Attorney, Agent, or Firm* — Waller Lansden Dortch & Davis LLP; Nathan J. Bailey

(57) ABSTRACT

A bridge assembly for a stringed instrument including an assembly body including a rounded rocker portion positionable against the stringed instrument. The assembly body is rockable on the stringed instrument. A string height adjustment member is connectable to the stringed instrument and extendable through the assembly body. When the rounded rocker portion of the assembly body is positioned against the stringed instrument, and the string height adjustment member extends through the assembly body and connects the assembly body to the stringed instrument, the string height adjustment member is operable to rock the assembly body on the stringed instrument via the rounded rocker member and adjust the height of a string resting on the assembly body. The bridge assembly can be used to adjust the height and intonation of, and to provide an anchor for, a string resting on the bridge assembly. A stringed instrument including the improved bridge assembly.

20 Claims, 6 Drawing Sheets

BRIDGE AND BRIDGE ASSEMBLY FOR STRINGED INSTRUMENTS

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates generally to bridges and bridge assemblies for stringed instruments, including but not limited to, electric and acoustic guitars, basses, violin, cellos, banjos, etc.

More particularly, the present disclosure relates to an improved bridge assembly for stringed instruments. Bridges for stringed instruments lift the instrument's strings so there is an appropriate distance between the strings and the fretboard or fingerboard on a neck of the instrument. The string can be anchored to the body of the instrument, cross over a contact point on the bridge and be suspended over the fretboard between the contact point on the bridge and a nut positioned at the top of a neck of the instrument.

These bridges are generally adjustable in height such that the distance between the string and fingerboard or fret board can be adjusted to accommodate a particular instrument or the preferences of a particular player or user of the instrument. It is from this distance that the player depresses the string to contact the fingerboard to sound a particular note. In combination with the gauge, or diameter of the guitar strings, this distance is generally referred to as the "action" of the stringed instrument. Such bridges typically also provide adjustment for the length of the string. This is referred to as "setting the intonation" of the string. This adjustment allows the player to play notes "in tune" along the length of the string from the nut to the end of the fingerboard. To adjust the intonation of a string, the open string is plucked and tuned to a proper pitch. The player then depresses the string at an appropriate fret generally in the middle of the fingerboard or fret board, for instance at the $12^{th}$ fret of a guitar. The player can then adjust the pitch of the depressed string by moving the bridge toward or away from the neck of the guitar as needed.

Additionally, in many conventional stringed instruments, holes are drilled through the body of the instrument, and the strings extend through the body and are connected to ferrules positioned on the backside of the instrument. In other embodiments, the string can be anchored to an additional device known as a tailpiece or stop bar. Either configuration can substantially increase manufacturing time for the instruments, which is undesirable.

Conventionally, the height of the strings has been adjusted using two general approaches. The first approach features a metal bridge assembly resting on two threaded poles or posts, one at each end. These poles or posts are mounted into a threaded base in the instrument's top. The poles or posts can be raised or lowered by turning their threaded shafts, thus raising or lowering them in much the same manner as screwing a screw into or out of a piece of wood. These bridges, however, do not have separate height adjustment for individual strings on the instrument.

The second approach uses a metal plate securely mounted to the instrument body and individual bridge pieces attached to the metal plate upon which the strings rest. These bridge pieces are secured to the plate with multiple adjustment screws, sometimes called feet. The height of the bridge pieces, and subsequently the height of the strings associated therewith, can be adjusted by turning each of the feet of the bridge pieces. As such, adjustment of the height of each string requires adjustment multiple screws or feet, which is cumbersome and undesirable.

Furthermore, different adjustments of the bridge and/or tailpiece components can require different tools. For example, a tool for securing the bridge to the posts of the guitar would not be useable to adjust the height of a particular saddle or bridge piece. Often times the screws used for different aspects of the bridge are different sizes or shapes. Thus, a guitarist would need to carry a plurality of tools in order to be able to make all of the different adjustments to the bridge and/or stopbar (or tailpiece).

Each approach uses a similar method for setting the length of the string, also known as the "intonation" of the string. This is done by moving individual bridge piece(s) forwards or backwards by turning a screw or bolt which is attached to the individual bridge piece. The screw or bolt is anchored to the bridge plate and is often held in place in between the bridge piece and bridge plate in tension provided by a spring installed around the intonation adjustment screw or bolt.

As such, adjustment of the string height and intonation of strings on conventional stringed instruments can be cumbersome and can require the adjustment of numerous pieces or screws, and can additionally require multiple tools, which is undesirable.

What is needed then are improvements to bridges and bridge assemblies for stringed instruments.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

One aspect of the disclosure is a bridge assembly for a stringed instrument including an assembly body including a rounded rocker portion positionable against the stringed instrument such that the assembly body is rockable on the stringed instrument, and a string height adjustment member connectable to the stringed instrument and extendable through the assembly body. When the assembly body is positioned on the stringed instrument with the rounded rocker portion positioned against the stringed instrument, and the string height adjustment member extends through the assembly body and connects the assembly body to the stringed instrument, the string height adjustment member is operable to rock the assembly body on the stringed instrument via the rounded rocker member.

Another aspect of the present disclosure is a bridge assembly for a stringed instrument having a main body, a neck, and one or more strings extending from the neck, the bridge assembly including an assembly body positionable on the main body of the stringed instrument. The assembly body, when positioned on the main body of the stringed instrument, can include a forward end oriented toward the neck, a back end oriented away from the neck, and a rounded rocker portion positioned between the forward end and the back end and oriented towards the main body of the stringed instrument. The assembly body is rockable on the main body of the stringed instrument via the rounded rocker portion. A string height adjustment member can be connectable to the main body of the stringed instrument and extendable through the assembly body at a location between the back end and the rounded rocker portion of the assembly body. When the assembly body is positioned on the main body, the string height adjustment member is connected to the main body and extends through the assembly body, and one of the strings rests on the forward end of the assembly body, the string height adjustment member is operable to rock the assembly body about the rounded rocker portion to adjust a height of the string with respect to the neck of the stringed instrument. As such, the string height adjustment member can both attach the assembly body to the instrument main body and be operable to adjust the height of the string.

Another aspect of the present disclosure is a stringed instrument including a main body, a neck extending from the main body, one or more strings connected to the neck and extending toward the main body, and a bridge assembly. The bridge assembly can include an assembly body positioned on the main body. The assembly body includes a forward end oriented toward the neck, a back end oriented away from the neck, and a rounded rocker portion oriented towards the main body. The assembly body is rockable on the main body via the rounded rocker portion. A string height adjustment member is connected to the main body and extends through the assembly body at a location between the back end and the rounded rocker portion of the assembly body. One of the strings rests on the forward end of the assembly body, and the string height adjustment member is operable to rock the assembly body about the rounded rocker portion to adjust a height of the string resting on the forward end of the assembly body with respect to the neck. The stringed instrument can include a plurality of similar bridge assemblies making up a stringed instrument bridge, each string of the stringed instrument associated with a corresponding bridge assembly of the plurality of bridge assemblies.

One objective of the present disclosure is to help increase the ease and efficiency of adjusting the string height of strings on a stringed instrument.

Another objective of the present disclosure is to help reduce the number of parts in conventional stringed instrument bridges and bridge assemblies.

Another objective of the present disclosure is to help decrease the number of tools needed to adjust the string height and intonation of strings on a stringed instrument.

Another objective of the present disclosure is to help ease the installation and manufacture of bridges and bridge assemblies on stringed instruments.

Numerous other objects, advantages and features of the present disclosure will be readily apparent to those of skill in the art upon a review of the following drawings and description of a preferred embodiment.

DETAILED DESCRIPTION

Figure 1:
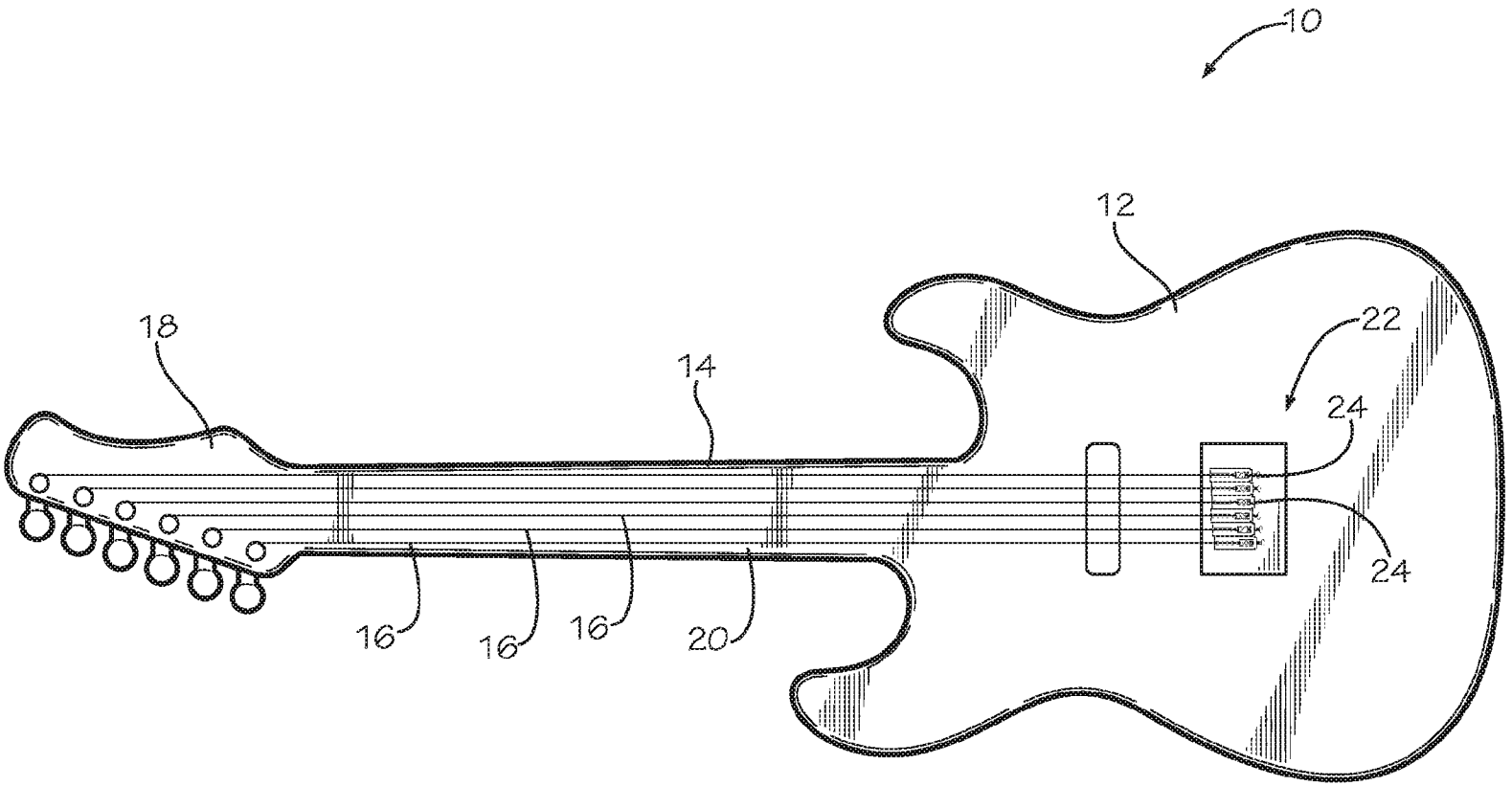
FIG. 1 is a top view of an embodiment of a stringed instrument of the present disclosure having a stringed instrument bridge including a plurality of improved bridge assemblies.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing, or as otherwise described. A person of skill in the art will recognize that the apparatus can assume different orientations when in use.

One embodiment of a stringed instrument 10 of the present disclosure is shown in FIG. 1. Stringed instrument 10 can include a main body 12, a neck 14 extending from main body 12, and one or more strings 16 extending from neck 14. Strings 16 can be connected to neck 14 at a head 18 of neck 14, and strings 16 can extend toward main body 12 and be connected to main body 12 or some component attached to main body 12 such that strings 16 can be suspended over fret board or fingerboard 20. Stringed instrument 10 can include an improved bridge 22 positioned on main body 12. Bridge 22 can include a plurality of bridge assemblies 24.

An embodiment of an improved bridge assembly 24 of the present disclosure is shown in FIGS. 2-5. Bridge assembly 24 can include an assembly body 26. Assembly body 26 can include a rounded rocker portion 28. Rounded rocker portion 28 can be positioned or positionable against main body 12 of stringed instrument 10 such that assembly body 26 is rockable on stringed instrument 10 about rounded rocker portion 28. Rounded rocker member 28 can generally be positioned between opposing ends 30 and 32 of assembly body 26. As such, when assembly body 26 is positioned on main body 12, assembly body 26 can rock or teeter about or on rounded rocker member 28.

Figure 4:
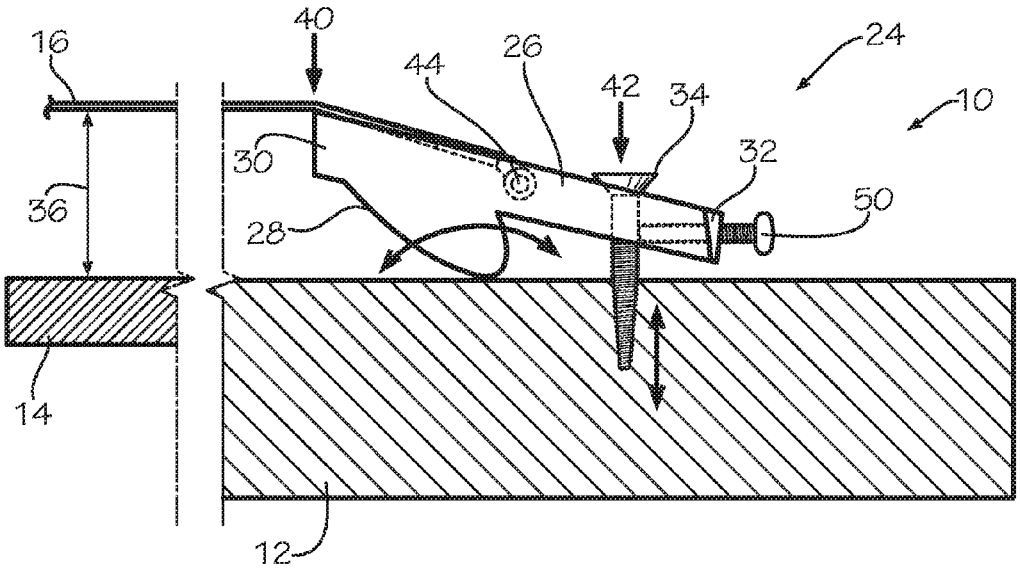
FIG. 4 is a partial side cross-section view of one of the bridge assemblies of FIG. 1.
Figure 5:
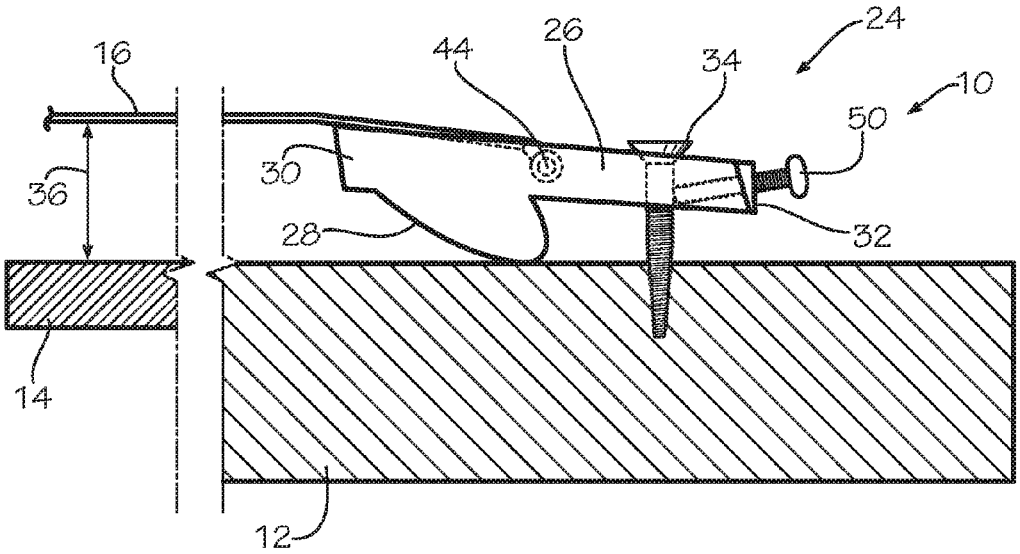
FIG. 5 is a partial side cross-section view of the bridge assembly of FIG. 6 rocked to an adjusted position by a string height adjustment member.

Bridge assembly 24 can also include a string height adjustment member 34. String height adjustment member 34 can be extendable through assembly body 26 and connectable to main body 12 of stringed instrument 10, as shown in FIGS. 4-5. When assembly body 26 is positioned on main body 12 of stringed instrument 10 with rounded rocker portion 28 positioned against main body 12, and string height adjustment member 34 extends through assembly body 26 and connects to main body 12, string height adjustment member 34 can be operable to rock assembly body 26 on main body 12 via rounded rocker portion 28.

In some embodiments, as shown in FIGS. 4-5, assembly body 26, when positioned in main body 12, can include a forward end 30 oriented toward neck 14 of stringed instrument 10, and a back end 32 oriented away from neck 14. One of strings 16 can extend from neck 14 and rest on forward end 30 of assembly body 26, such that the position of forward end 30 can define a height 36 of string 16 with respect to neck 14 of stringed instrument 10. In other embodiments, string 16 can rest on back end 32 of assembly body 26, such that the position of back end 32 can define a height of string 16 with respect to neck 14 of stringed instrument 10. In some embodiments, string height adjustment member 34 can be extendable through assembly body 26 at a location between rounded rocker portion 28 and back end 32. In other embodiments, string height adjustment member 34 can be extendable through assembly body 26 at a location between rounded rocker portion 28 and forward end 30. As such, string 16 can rest on either a forward end 30 or a back end 32 of assembly body 26 and string height adjustment member 34 can be generally offset from rounded rocker portion 28 such that as string height adjustment member 34 is operated, string height adjustment member 34 can apply a force on assembly body 26 at a location offset from rounded rocker member 28 such that string height adjustment member 34 rocks assembly body 26 on rounded rocker member 28.

In one embodiment, as shown in FIGS. 4-5, string 16 can rest on forward end 30 of assembly body 26, and string height adjustment member 34 extends through assembly body 26 at a location between rounded rocker portion 28 and back end 32 such that string height adjustment member 34 can be operated without interference from string 16.

Figure 2:
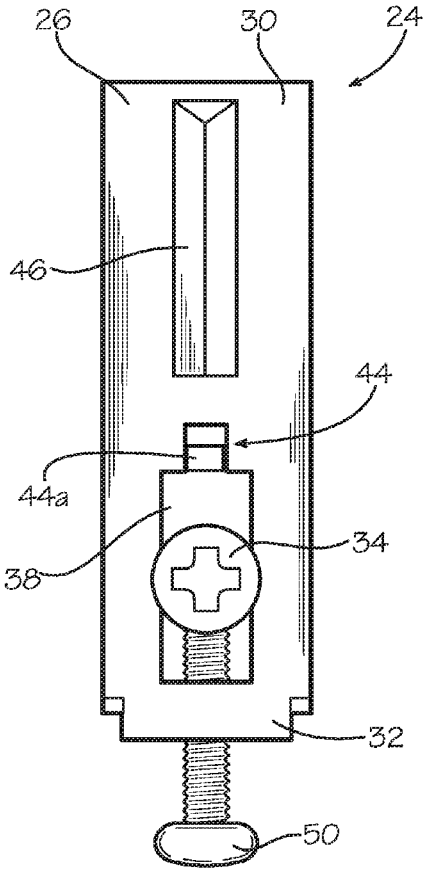
FIG. 2 is a top detailed view of one of the bridge assemblies of FIG. 1.
Figure 3:
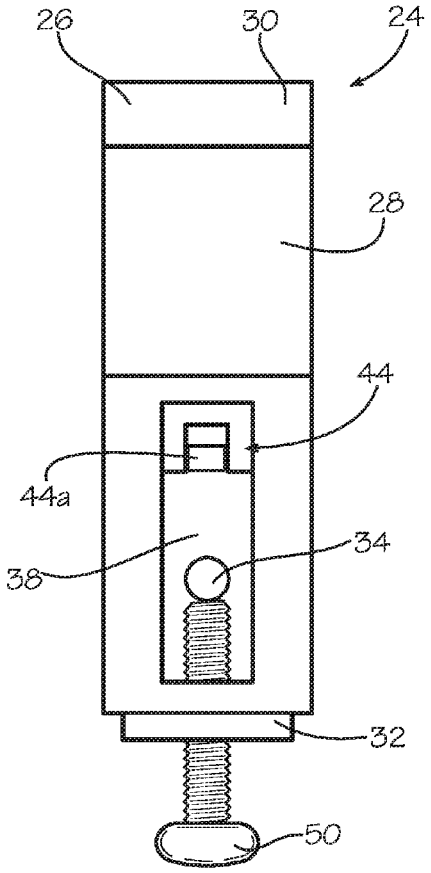
FIG. 3 is a bottom detailed view of the bridge assembly of FIG. 2.

In some embodiments, as shown in FIGS. 2-3, assembly body 26 can include an aperture 38 defined through assembly body 26. Aperture 38 can be sized and shaped to receive string height adjustment member 34. In some embodiments, aperture 38 can be an elongated opening through assembly body 26 that is longer than the width of string height adjustment member 34, such that as string height adjustment member 34 is operated and assembly body 26 rocks or moves on main body 12, string height adjustment member 34 can slide or move within aperture 38 to help reduce or prevent interference between string height adjustment member 34 and assembly body 26 as assembly body 26 rocks or moves on main body 12. Aperture 38 can be defined between an end of assembly body 26 and rounded rocker portion 28. In FIGS. 2-3, aperture 38 is shown defined between rounded rocker portion 28 and back end 32. In other embodiments, aperture 38 can be defined between rounded rocker portion 28 and forward end 30. The position of aperture 38 within assembly 26 can generally correspond to the desired location where string height adjustment member 34 extends through assembly body 26.

String 16 can generally be anchored at one end to neck 14 or a head 18 of neck 14, and anchored at an opposing end to main body 12 or to some component connected to main body 12. String 16 can be tensioned to a desired level such that as string 16 is plucked, a sound with a desired pitch is produced. When string 16 rests on forward end 30 of assembly body 26, the tensioning of string 16 can bias forward end 30 of assembly body 26 in a direction toward main body 12. String tension force 40 shown in FIGS. 4-5 can be oriented in a direction downward or toward main body 12.

String height adjustment member 34 can be configured to resist the biasing of forward end 30 of assembly body 26 by string 16. String height adjustment member 34 in some embodiments can engage an upper surface of assembly body 26, or a surface positioned opposite rounded rocker member 28 on assembly body 26, to provide a string height adjustment member force 42 in a direction toward main body 12. String height adjustment member force 42 can be applied at a location on assembly body 26 between rounded rocker member 28 and back end 32 to balance the biasing force 40 applied on forward end 30 by string 16. In other embodiments, string height adjustment member 34 can engage a lower surface of assembly body 26, or a surface positioned on the same side of assembly body 26 as rounded rocker portion 28, to provide a force in a direction away from main body 12. Such a string height adjustment member force away from main body 12 can be applied at a location on assembly body between rounded rocker portion 28 and forward end 30 to balance the force 40 applied on forward end 30 by string 16.

In some embodiments, as shown in FIGS. 2-3, string height adjustment member 34 can be a screw or bolt that can be selectively screwed into and out of main body 12 in order to adjust the height of a head of string height adjustment member 34. In some embodiments, string height adjustment member 34 can have a pointed end that can be screwed directly into main body 12. In other embodiments, main body 12 can include a threaded recess which can receive string height adjustment member 34, the threads of string height adjustment member 34 engaging the threads of the threaded recess of main body 12. Movement of the head of string height adjustment member can allow a defined rocking or motion of assembly body 26 such that height 36 of string 16 with respect to neck 14 can be varied.

For instance, in FIGS. 4-5, when string height adjustment member 34 is screwed into main body 12, string height adjustment member 34 overcomes the string tension force 40 and moves back end 32 of assembly body downward toward main body 12. Assembly body 26 rocks about rounded rocker portion 28 such that forward end 30 moves upward or away from main body 12 to increase the height 36 of string 16. When string height adjustment member 34 is loosened or screwed out of main body 12, string height adjustment member 34 allows string tension force 40 to rock assembly body 26 about rounded rocker portion 28 such that forward end 30 moves toward main body 12 to decrease height 36 of string 16 with respect to neck 14. Back end 32 when string height adjustment member 34 is loosened thus moves away from main body 12 and remains engaged with string height adjustment member 34, such that string height adjustment member 34 limits to rocking or motion of assembly body 26.

In FIGS. 4-5, string height adjustment member 34 can be loosened or screwed outward from the position shown in FIG. 4 to the position in FIG. 5, which lowers height 36 of string 16. From the position shown in FIG. 5, string height adjustment member 34 can be screwed into main body 12 to return forward end 30 of assembly body 26 and string 16 to the position shown in FIG. 4. As such, height 36 of string 16 can be selectively varied via bridge assembly 24 by simply turning or adjusting a single string height adjustment member 34.

In some embodiments, as shown in FIGS. 2-5, bridge assembly 24 can include an integrated string anchor 44. Integrated string anchor 44 can be integrally formed or defined on assembly body 26. Integrated string anchor 44 can be engageable with string 16. As such, string 16 can be engageable or anchorable directly with bridge assembly 24 and assembly body 26. Vibrations from string 16 as stringed instrument 10 is played can thus be transferred to main body 12 of stringed instrument 10 via bridge assembly 24 and assembly body 26. Having a string anchor 44 integrated into assembly body 26 such that string 16 can be anchored directly to bridge assembly 24 can help eliminate the need for string 16 to be connected or anchored to main body directly or via another component which is mounted to main body 12, such as a tail piece or stop bar.

In some embodiments, integrated string anchor 44 can be a string hole defined in assembly body 26. A string having a string ball or other knot in the string can be inserted through the integrated string anchor hole and the ball or knot of the string can engage a periphery of the hole when the string is tensioned to secure string 16 to assembly body 26. In other embodiments, integrated string anchor 44 can include an anchor rod member 44*a* or other suitable structure to which string 16 can be tied around to secure string 16 to assembly body 26. In some embodiments, anchor rod member 44*a* can be positioned next to a string hole, as shown in FIGS. 2-3, such that a string can be inserted through the string hole and tied around anchor rod member 44*a*. Anchor rod member 44*a* can have a circular, square, rectangular, triangular, or other suitably shaped cross section.

In embodiments where string 16 rests on forward end 30 of assembly body 26, string 16 can extend from forward end 30 to integrated string anchor 44, string 16 being secured or engaged with integrated string anchor 44 such that string 16 is retained in a resting position on forward end 30 of assembly body 26. In some embodiments, assembly body 26 can include a string guide channel 46 positioned between forward end 30 of assembly body 26 and integrated string anchor 44 such that string 16 can be positioned in string guide channel 46 to retain string 16 in a desired location on assembly body 26. In some embodiments, string guide channel 46 can extend through forward end 30 such that string guide channel 46 defines a notch in forward end 30 of assembly body 26 into which string 16 can be received. The width of assembly body 26, as well as the width of string guide channel 46, can be large enough such that strings 16 of varying size or gauge can be utilized and rested on assembly body 26. As such, bridge assemblies 24 and assembly bodies 26 can be interchangeable between strings 16 having different sizes or gauges. In one embodiment, assembly bodies 26 can have dimensions of about 1.5 inches in length, 0.5 inches in width, and 0.4 inches in height.

Figure 8:
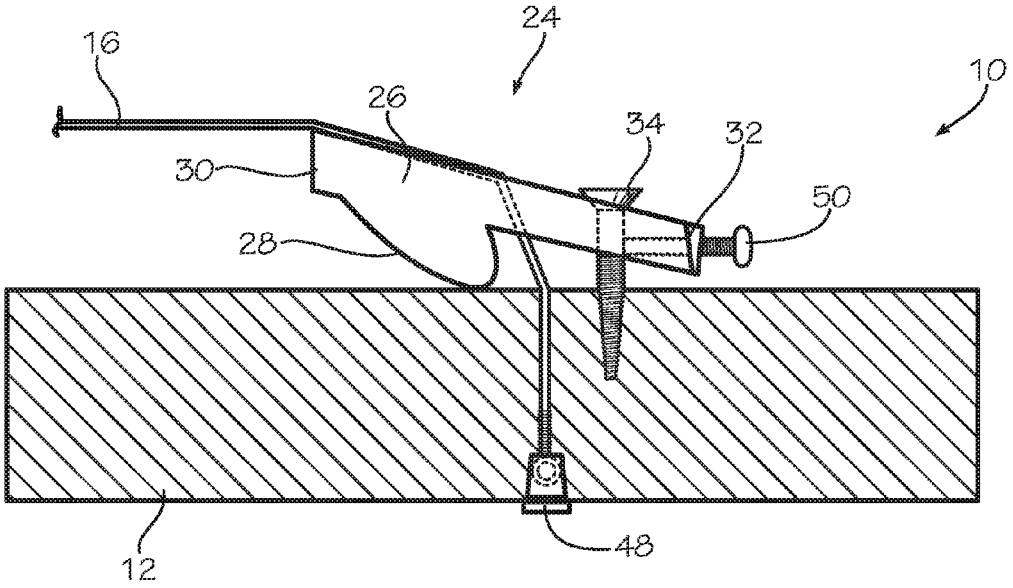
FIG. 8 is a partial side cross-section view of another embodiment of a stringed instrument of the present disclosure where a string extends through the bridge assembly and through a main body of the stringed instrument.

In still other embodiments, string 16 can be anchored to the neck of stringed instrument 10 and main body 12 or another component of stringed instrument 10 attached to main body, such that tension can be produced in string 16. The tension can bias forward end 30 of assembly body 26 in a direction toward main body 12, string height adjustment member 34 resisting the biasing of forward end 30 of assembly body 26. For instance, in FIG. 8, string 16 extends through main body 12 and is secured to a ferrule 48 positioned on a back side of main body 12, similar to many conventional guitars. String 16 can extend through assembly body 26 in such embodiments and through main body 12. String 16 can be tensioned once secured to main body 12 and assembly body 26 can rock on rounded rocker portion 28 in response to the tension in string 16 and operation of string height adjustment member 34, as previously described. In some embodiments, string 16 can extend through assembly body 26 at a position forward of string height adjustment member 34 to help reduce interference of string 16 with the operation of string height adjustment member 34.

Referring again to FIGS. 2-5, in some embodiments, bridge assembly 24 can include an intonation adjustment member 50 extendable through assembly body 26, and particularly through an end 30 or 32 of assembly body 26. When string height adjustment member 34 extends through assembly body 26 and intonation adjustment member 50 extends through an end of assembly body 26, intonation adjustment member 50 can be positionable against string height adjustment member 34 to engage string height adjustment member 34. When assembly body 26 is positioned on main body 12, string height adjustment member 34 extends through assembly body 26 and connects to main body 12, and intonation adjustment member 50 extends through an end of assembly body 26 and is positioned against string height adjustment member 34, intonation adjustment member 50 can be operable to move assembly body 26 relative to string height adjustment member 34.

When string 16 is anchored to assembly body 26 or to main body 12, moving assembly body 26 relative to string height adjustment member 34, which effectively moves assembly body 26 relative to main body 12, can adjust the length of string 16 from its contact point on neck 14 to the contact point of string 16 on assembly body 26, the contact point being forward end 30 of assembly body 26 in FIGS. 2-5. Adjusting the length of string 16 can adjust the intonation of string 16 such that string 16 can remained in tune when string 16 is depressed at different locations along a fretboard 20 of stringed instrument 10 as stringed instrument 10 is played.

Tension in string 16 can generally bias assembly body 26 in a direction toward neck 14 of stringed instrument 10. In some embodiments, intonation adjustment member 50 can be threadingly engaged with an end of assembly body 26, such that when intonation adjustment member 50 is positioned against string height adjustment member 34 secured to main body 12, string height adjustment member 34 can act as a stop for intonation adjustment member 50 threadingly secured to assembly body 26. As such, the interaction of intonation adjustment member 50 and string height adjustment member 34 can resist motion of assembly body 26 toward neck 14.

In some embodiments, as shown in FIGS. 4-5, intonation adjustment member 50 can be a bolt or screw which can be operable to screw into or out of an end of assembly body 26. In some embodiments, string height adjustment member 34 can extend between rounded rocker portion 28 and back end 32 and intonation adjustment member 50 can extend through and be threadingly engaged with back end 32 of assembly body 26. As such, intonation adjustment member 50 can be operable to screw into and out of back end 32 of assembly body 26. As intonation adjustment member 50 screws into back end 32 of assembly body 26, intonation adjustment member 50 being positioned against string height adjustment member 34 causes assembly body 26 to translate along intonation adjustment member 50 in a direction away from neck 14. As intonation adjustment member 50 screws out of back end 32 of assembly body 26, tension in string 16 pulls assembly body 26 in a direction toward neck 14 to keep intonation adjustment member 50 positioned against string height adjustment member 34. As such, the position of assembly body 26 relative to string height adjustment member 34 and main body 12 can be adjusted via intonation adjustment member 50 to adjust the length of string 16 and the intonation of string 16 on stringed instrument 10.

In some embodiments, both string height adjustment member 34 and intonation adjustment member 50 can comprise bolts or screws having the same screw head type. For instance, in some embodiments, both adjustment members 34 and 50 can be one of Philips screw head types, flat head screw head types, or hex screw head types. As such, a single tool can be used by a user or player of stringed instrument 10 to adjust string height as well as intonation of a string 16. Such a configuration can help increase efficiency over conventional bridges for stringed instruments, where adjustment members utilize different screw head types and thus require a large number of tools to adjust both the string height and intonation of a string 16.

Having a bridge assembly 24 where a string height adjustment member 34, an intonation adjustment member 50, and a string anchor 44 are all integrated or disposed on a single assembly 24 can help ease manufacture of stringed instruments needing adjustable bridge assemblies. To install bridge assembly 24 of FIGS. 4-5 on main body 12 of stringed instrument 10, assembly body 26 can be positioned on main body 12, string height adjustment member 34 can be inserted or extended through assembly body 26 and connected to main body 12, intonation adjustment member 50 can be extended through a back end 32 of assembly body 26 and positioned against string height adjustment member 34, and string 16 can be anchored to string anchor 44. As such, when string height adjustment member 34 is a screw, installation only requires installing one screw for each bridge assembly 24 into main body 12, and/or drilling a single pilot hole into main body 12 for each bridge assembly 24.

Additionally, bridge assemblies of FIGS. 2-5 include a single adjustment member for string height and a single adjustment member for intonation. Such a configuration can provide increased efficiency over conventional models where multiple adjustment members are utilized to adjust the string height of an individual string.

Figure 6:
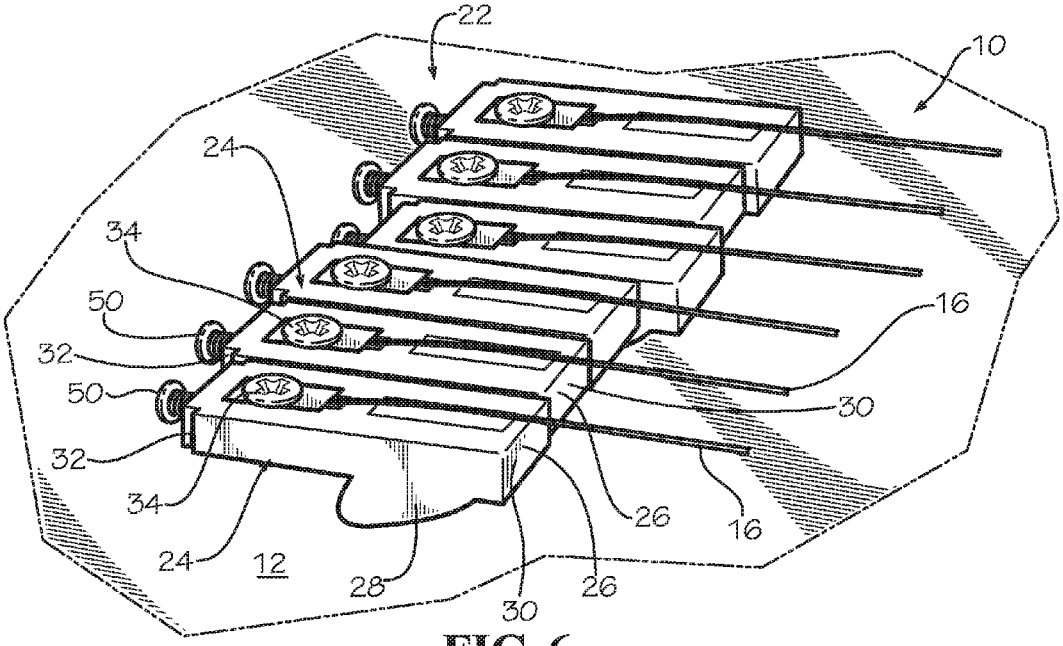
FIG. 6 is a perspective view of the plurality of bridge assemblies of FIG. 1.
Figure 7:
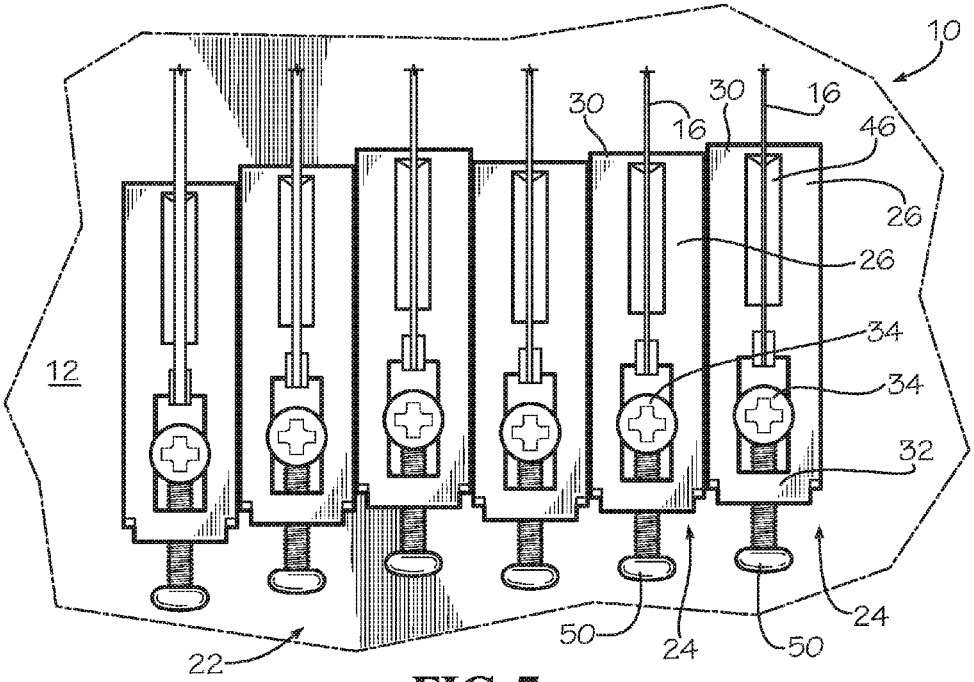
FIG. 7 is a top view of the plurality of bridge assemblies of FIG. 1.

Referring now to FIGS. 6-7, in some embodiments, stringed instrument 10 can include a plurality of strings 16 extending from the neck of stringed instrument 10, and bridge 22 can include a plurality of bridge assemblies 24. Each bridge assembly 24 can include an assembly body 26 positioned or positionable on main body 12. Assembly body 26 can include a forward end 30 oriented toward the neck of stringed instrument 10, a back end 32 oriented away from the neck of stringed instrument 10, and a rounded rocker portion 28 oriented toward main body 12. Assembly body 26 is rockable about rounded rocker portion 28 on main body 12. Each bridge assembly 24 can also include a string height adjustment member 34 connected or connectable to main body 12 and extending through assembly body 26 between a back end 32 of assembly body 26 and rounded rocker portion 28. Each string 16 of stringed instrument 10 can rest on the forward end 30 of the assembly body 26 of a corresponding bridge assembly 24. Each string height adjustment member 34 can be operable to rock a corresponding assembly body 26 via a corresponding rounded rocker portion 28. As such, a plurality of bridge assemblies 24 can be coupled to corresponding strings 16 on stringed instrument 10 such that the heights of strings 16 and the intonation of strings 16 can be adjusted individually with the improved bridge assemblies 24.

Bridge 22 is shown in FIGS. 6-7 as having 6 bridge assemblies 24 accommodating six strings 16 of stringed instrument 10. In other embodiments, the number of bridge assemblies on stringed instrument 10 can be varied in order to accommodate varying numbers of strings 16 on stringed instrument 10. In some embodiments, stringed instrument 10 can include 3, 4, 5, 6, 7, or 8 pairs of strings 16 and corresponding bridge assemblies 24. Additionally, the width of the assembly bodies 26 of the plurality of bridge assemblies can be varied for different stringed instruments 10 to accommodate varying string spacing on the neck of stringed instrument 10. In some embodiments, adjacent bridge assemblies 24 can abut one another to keep bridge assemblies generally parallel to each another. In other embodiments, adjacent bridge assemblies 24 can be spaced apart from one another.

Additionally, different materials can be used to manufacture bridge assemblies 24, and particularly assembly bodies 26, in order to produce different sound characteristics affecting volume, tone color, and sustain of vibrations of strings 16 when stringed instrument 10 is played. Such materials can include, but are not limited to, metals such as brass, stainless steel, titanium, iron, etc., graphite, plastics, thermoplastics, or other suitable polymers.

Figure 9:
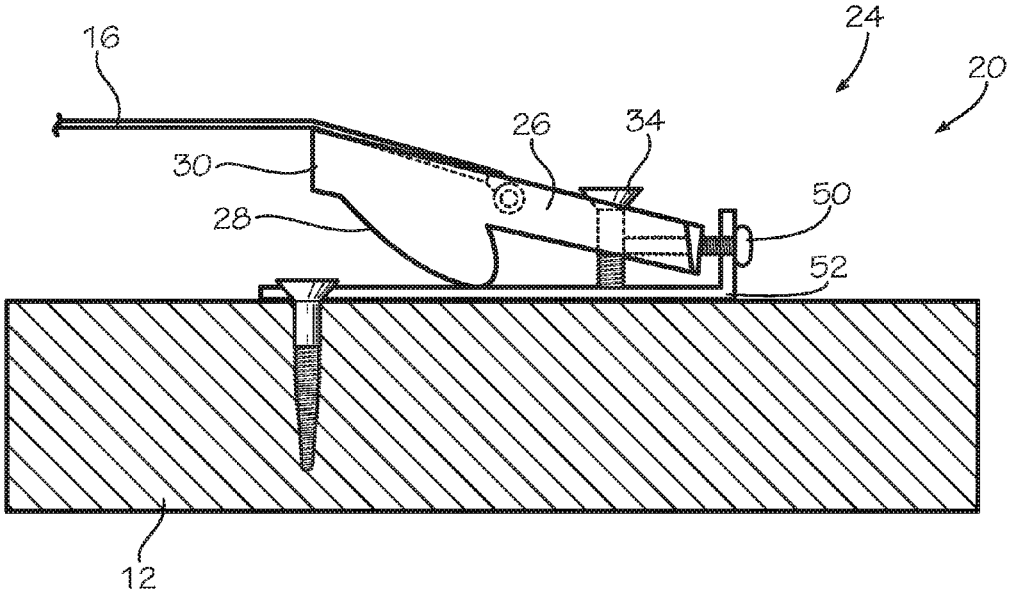
FIG. 9 is a partial side cross-section view of another embodiment of a stringed instrument of the present disclosure where the bridge assembly includes a bridge plate mounted to a main body of the stringed instrument.
Figure 10:
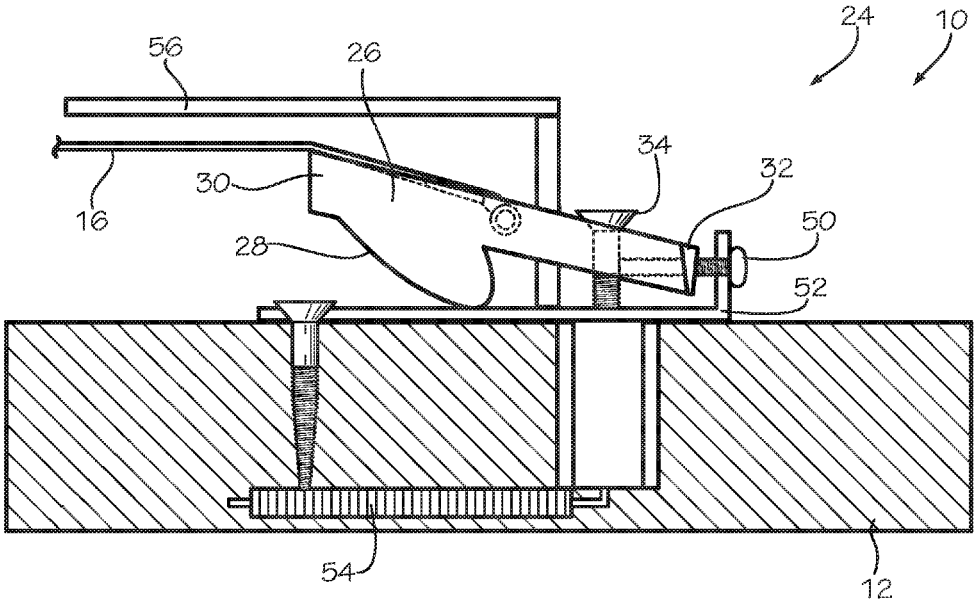
FIG. 10 is a partial side cross-section view of another embodiment of a stringed instrument of the present disclosure showing an improved bridge assembly mounted to a tremolo style bridge plate.

In some embodiments, as shown in FIGS. 9-10, bridge assembly 24 can include a bridge plate 52 mountable to main body 12. Assembly body 26 can be positioned on, and rounded rocker portion 28 can be positioned on or against, bridge plate 52 such that assembly body 26 is positioned on main body 12 via bridge plate 52. Additionally, string height adjustment member 34 can be connected to bridge plate 52 such that string height adjustment member 34 is connected to main body 12 via bridge plate 52. In some embodiments, string height adjustment member 34 can be a screw or bolt and bridge plate 52 can have a threaded recess which can receive string height adjustment member 34. Additionally, because bridge assembly 24 can be connected to a conventional bridge plate 52, an improved bridge assembly 24 of the present disclosure can be retrofitted onto existing stringed instruments already including a bridge plate 52 secured to main body 12 of stringed instrument 10. In those embodiments including a plurality of strings and a plurality of corresponding bridge assemblies, the various assembly bodies 26 of the bridge assemblies 24 can be positioned on a single bridge plate 52.

Additionally, in some embodiments, bridge plate 52 of bridge assembly 24 of stringed instrument 10 can be a tremolo style bridge plate 52 as shown in FIG. 10. In such embodiments, bridge plate 52 can be biased against main body 12 by one or more springs 54 connected to main body 12. Bridge plate 52 can be movable or rotatable relative to main body 12 to temporarily change the pitch of string 16 resting on bridge assembly 24. When bridge plate 52 moves toward the neck of stringed instrument 10, the pitch of string 16 can get lower, and when bridge plate 52 moves away from the neck of stringed instrument 10, the pitch of string 16 can get higher. Bridge plate 52 can include a handle 56 in some embodiments to provide the player leverage for moving bridge plate 52 during use. In some embodiments, handle 56 can be rotatable on bridge plate 52 such that handle 56 can be used to move bridge plate 52 in either a forward or backward direction. The ability to temporarily change the pitch of string 16 can be useful to produce varying sound effects as stringed instrument 10 is played. Improved bridge assemblies 24 can thus be retrofitted to existing stringed instruments having tremolo style bridge plates 52.

In some embodiments, magnetic pickups or piezo elements can be integrated into the bridge assembly, for instance on a bridge plate 52 of bridge assembly 24. As such, magnetic pickups and piezo elements associated with electric guitars or other electric instruments can be incorporated or integrated into bridge assemblies 24 which can further help increase the efficiency of manufacturing stringed instruments.

Thus, although there have been described particular embodiments of the present invention of a new and useful BRIDGE AND BRIDGE ASSEMBLY FOR STRINGED INSTRUMENTS, it is not intended that such references be construed as limitations upon the scope of this invention.

What is claimed is:

1. A bridge assembly for a stringed instrument comprising:

an assembly body including a rounded rocker portion positionable against the stringed instrument such that the assembly body is rockable on the stringed instrument; and a string height adjustment member connectable to the stringed instrument and extendable through the assembly body;

wherein when the assembly body is positioned on the stringed instrument with the rounded rocker portion positioned against the stringed instrument, and the string height adjustment member extends through the assembly body and connects the assembly body to the stringed instrument, the string height adjustment member is operable to rock the assembly body on the stringed instrument via the rounded rocker member.

2. The bridge assembly of claim 1, wherein the assembly body has an end, and the bridge assembly further comprises:

an intonation adjustment member extendable through the end of the assembly body, the intonation adjustment member positionable against the string height adjustment member when the string height adjustment member extends through the assembly body and the intonation adjustment member extends through the end of the assembly body;

wherein when the assembly body is positioned on the stringed instrument, the string height adjustment member extends through the assembly body and connects to the stringed instrument, and the intonation adjustment member extends through the end of the assembly body and is positioned against the string height adjustment member, the intonation adjustment member is operable to move the assembly body relative to the string height adjustment member.

3. The bridge assembly of claim 1, wherein the intonation adjustment member is threadingly engageable with the end of the assembly body.

4. The bridge assembly of claim 1, wherein the assembly body further comprises an aperture positioned between the rounded rocker portion and an end of the assembly body, the aperture sized to receive the string height adjustment member.

5. A bridge assembly for a stringed instrument having a main body, a neck, and one or more strings extending from the neck, the bridge assembly comprising:

an assembly body positionable on the main body of the stringed instrument, the assembly body, when positioned on the main body of the stringed instrument, including:

a forward end oriented toward the neck;

a back end oriented away from the neck; and a rounded rocker portion positioned between the forward end and the back end and oriented towards the main body of the stringed instrument, the assembly body rockable on the main body of the stringed instrument via the rounded rocker portion; and a string height adjustment member connectable to the main body of the stringed instrument and extendable through the assembly body at a location between the back end and the rounded rocker portion of the assembly body;

wherein when the assembly body is positioned on the main body, the string height adjustment member is connected to the main body and extends through the assembly body, and one of the strings rests on the forward end of the assembly body, the string height adjustment member is operable to rock the assembly body about the rounded rocker portion to adjust a height of the string with respect to the neck of the stringed instrument.

6. The bridge assembly of claim 5, wherein the assembly body further comprises an integrated string anchor engageable with the string resting on the forward end of the assembly body, the integrated string anchor positioned between the forward end and the back end of the assembly body.

7. The bridge assembly of claim 6, wherein the integrated string anchor includes an anchor rod member.

8. The bridge assembly of claim 6, wherein the assembly body further comprises a string guide channel positioned between the forward end of the assembly body and the integrated string anchor.

9. The bridge assembly of claim 5, further comprising a bridge plate mountable to the main body of the stringed instrument, the assembly body positionable on the bridge plate such that the assembly body is positionable on the main body of the stringed instrument via the bridge plate.

10. The bridge assembly of claim 9, wherein the string height adjustment member is connectable to the bridge plate such that the string height adjustment member is connectable to the main body via the bridge plate.

11. The bridge assembly of claim 5, wherein the assembly body further comprises an aperture positioned between the rounded rocker portion and the back end of the assembly body, the aperture sized to receive the string height adjustment member.

12. A stringed instrument comprising:

a main body, a neck extending from the main body, one or more strings connected to the neck and extending toward the main body; and a bridge assembly comprising:

an assembly body positioned on the main body, the assembly body including a forward end oriented toward the neck, a back end oriented away from the neck, and a rounded rocker portion oriented towards the main body, the assembly body rockable on the main body via the rounded rocker portion; and a string height adjustment member connecting the assembly body to the main body and extending through the assembly body at a location between the back end and the rounded rocker portion of the assembly body;

wherein one of the strings rests on the forward end of the assembly body, and the string height adjustment member is operable to rock the assembly body about the rounded rocker portion to adjust a height of the string resting on the forward end of the assembly body with respect to the neck.

13. The stringed instrument of claim 12, wherein:

the string resting on the forward end of the bridge assembly is connected to the neck and the main body;

the string biases the forward end of the assembly body in a direction toward the main body; and the string height adjustment member resists the biasing of the forward end of the assembly body toward the main body.

14. The stringed instrument of claim 12, wherein:

the string resting on the forward end of the bridge assembly is connected to the neck and the assembly body;

the string biases the forward end of the assembly body in a direction toward the main body; and the string height adjustment member resists the biasing of the forward end of the assembly body toward the main body.

15. The stringed instrument of claim 12, further comprising:

an intonation adjustment member extending through the back end of the assembly body, the intonation adjustment member positioned against the string height adjustment member, wherein the intonation adjustment member is operable to move the assembly body relative to the string height adjustment member in order to adjust intonation of the string resting on the forward end of the assembly body.

16. The stringed instrument of claim 12, further comprising:

a plurality of strings extending from the neck of the stringed instrument; and a plurality of bridge assemblies positioned on the main body, each bridge assembly comprising:

an assembly body positioned on the main body of the stringed instrument, the assembly body including a forward end oriented toward the neck, a back end oriented away from the neck, and a rounded rocker portion oriented towards the main body, the assembly body rockable on the main body via the rounded rocker portion; and a string height adjustment member connected to the main body and extending through the assembly body at a location between the back end and the rounded rocker portion of the assembly body;

wherein each string of the stringed instrument rests on the forward end of the assembly body of a corresponding bridge assembly.

17. The stringed instrument of claim 12, wherein the bridge assembly further comprises a bridge plate mounted to the main body, the bridge assembly positioned on the bridge plate and the string height adjustment member connected to the bridge plate such that the bridge assembly is positioned on the main body and the string height adjustment member is connected to the main body via the bridge plate.

18. The stringed instrument of claim 17, wherein the bridge plate is biased against the main body, the bridge plate moveable with respect to the main body to temporarily change the pitch of the string resting on the forward end of the assembly body.

19. The stringed instrument of claim 12, wherein:

the string height adjustment member is a screw; and when the string height adjustment member screws into the main body of the stringed instrument, the assembly body rocks about the rounded rocker portion such that the forward end of the assembly body moves away from the main body of the stringed instrument to increase the height of the string positioned on the forward end of the assembly body with respect to the neck.

20. The stringed instrument of claim 12, wherein:

the string height adjustment member is a screw; and when the string height adjustment member screws out of the main body of the stringed instrument, the assembly body rocks about the rounded rocker portion such that the forward end of the assembly body moves toward the main body of the stringed instrument to decrease the height of the string resting on the forward end of the assembly body with respect to the neck.

* * * * *